United States Patent [19]

Benessis et al.

[11] Patent Number: 4,860,394

[45] Date of Patent: Aug. 29, 1989

[54] HOSPITAL BED OR HOSPITAL TABLE

[75] Inventors: Philippe L. Benessis; Patrick H. Jannitte, both of Castelmaurou, France

[73] Assignee: Societe Sofratemed S.A., Plaisance du Touch, France

[21] Appl. No.: 122,069

[22] Filed: Nov. 18, 1987

[30] Foreign Application Priority Data

Nov. 18, 1986 [FR] France ..... 86 16511

[51] Int. Cl.[4] ..... A61G 7/00

[52] U.S. Cl. ..... 5/62; 5/63

[58] Field of Search ..... 5/61-63, 5/66, 68; 269/323-325

[56] References Cited

U.S. PATENT DOCUMENTS

| | | | |
|---|---|---|---|
| 2,833,587 | 5/1958 | Saunders | 5/63 X |
| 3,868,103 | 2/1975 | Pageot et al. | 5/66 X |
| 4,558,857 | 12/1985 | Heller | 269/325 |
| 4,572,493 | 2/1986 | Hubert | 269/325 |
| 4,685,159 | 8/1987 | Oetiker | 5/63 X |

FOREIGN PATENT DOCUMENTS

| | | | |
|---|---|---|---|
| 540368 | 4/1957 | Canada | 5/68 |
| 2513512 | 4/1983 | France | 5/63 |

*Primary Examiner*—Gary L. Smith
*Assistant Examiner*—Michael F. Trettel
*Attorney, Agent, or Firm*—Horst M. Kasper

[57] ABSTRACT

The object of the present invention is a hospital bed or a hospital table.

This bed or table comprise a base (1), a platform (2), a means (3) to adjust the height of the platform above the ground, a means (4) to adjust the inclination of the platform in proclivity/declivity, and a means (5) to adjust the inclination of the platform in cubitus/-decubitus.

The invention bed is particularly remarkable in that the means (5) comprises a center axis (19) to which are hinged two connecting rods in the manner of a hinge and in that one of these connecting rods is hinged to the framework of the platform of the bed and in that the other one of these connecting rods carries rollers which engage in a U-shaped roller track.

An electric jack of the screw or nut type is connected to each connection rod. This electric jack either modifies the angular position of the connection rods in relation to the center axis, or maintains the angular position.

12 Claims, 8 Drawing Sheets

FIG. 5
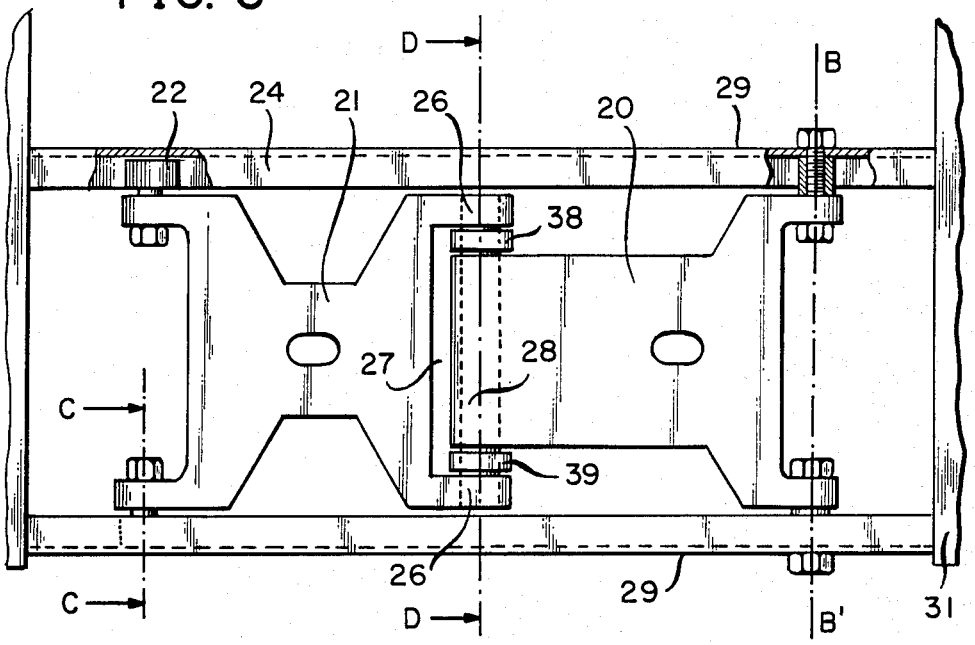
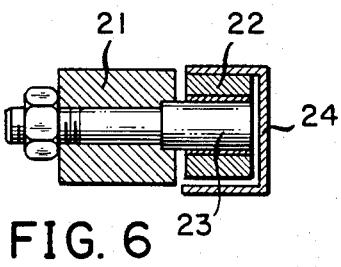
FIG. 6
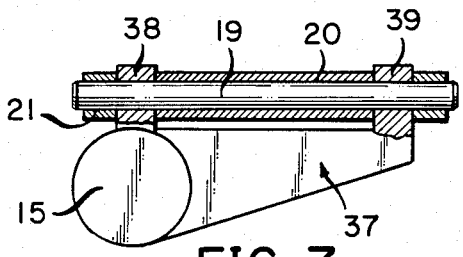
FIG. 7
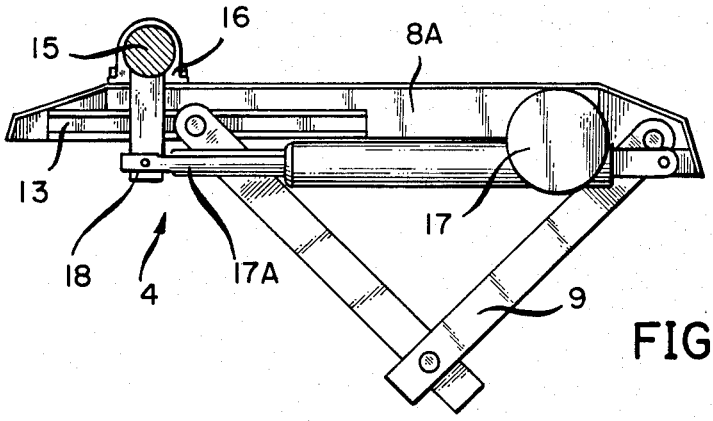
FIG. 4

HOSPITAL BED OR HOSPITAL TABLE

BACKGROUND OF THE INVENTION

1. Field of the Invention

The present invention relates to a hospital bed or a hospital table.

2. Brief Description of the Background of the Invention Including Prior Art

The beds or tables for medical examinations or surgical operations comprise a platform mounted on a support structure carried above the ground by a telescopic underframe or base. The support structure of the platform comprises a first assembly means to incline the platform laterally as well as from one side to the other, and a second assembly means to incline the platform either toward the front or toward the back. The first and the second assembly means are generally mounted onto one another according to a so-called open-chain configuration.

In order to activate the various elements, hydraulic driving elements, jacks, etc. are needed. Therefore, a hydraulic station has to be provided in proximity. Very often, the hydraulic station is mounted on the base of the bed, which limits the lowering possibilities of the platform.

It is particularly advantageous that the platform of the bed can be disposed at the vertical into an inclined or proclivity position. In order to achieve this, the platform has to be sufficiently elevated above the floor to avoid bumping against the floor during the inclination movement. Means that sufficiently elevate the platform from the floor are known. However, most of these means do not permit to sufficiently lower the platform of the bed.

This problem had priorly been solved by the use of a telescopic jack, i.e. a jack, the rod of which is made up of tubular elements slidingly mounted one in another. Even though this yielded good results, this solution has proven itself to be very costly and requires a very close and thorough maintenance.

In order to incline the platform laterally either to one side or to the other, there are often used a starting jack and a drive jack operating in synchronism and disposed on both sides of a center support. The platform of the bed is hinged to said center support.

There have been used other means for inclination of the platform. The drawback of these other means resides in the fact that they are formed by motor devices that are complex and delicate to implement and by numerous pieces for the transmission of the forces and the momvements.

Moreover, the automatic control means previously used do not permit to achieve gentle movements without any jolts or jerks.

Finally, it has become evident that the various hospital beds or tables, on account of their design, lend themselves poorly to an economical industrialization.

SUMMARY OF THE INVENTION

Purposes of the Invention

The object of the present invention is to obviate the previously stated drawbacks by putting into operation a novel type of bed of a simple design and at favorable manufacturing cost.

Another object of the invention is the implementation of a bed that does not require constant and continuous maintenance and, finally, the last object of the invention is a bed, the platform of which can be sufficiently lowered to facilitate its access to the sick person and can be sufficiently elevated above the ground to allow a sloped positioning close to the vertical, and laterally sufficiently inclined from one side like from the other.

These and other objects and advantages of the present invention will become evident from the description which follows.

Brief Description of the Invention

In the following the term "proclivity" refers to a bed position where the level of the bed is such inclined that the head of a sick person is found at a higher level relative to the feet of the sick person. The term "declivity" refers to a bed position where the level of the bed is inclined such that the feet of the sick person are at a higher level as compared to the head of the sick person.

The present invention provides for a hospital bed or hospital table which comprises a base, a platform consisting of several sections mounted on a set of means supported by the base, which set of means comprises a means for adjusting and modifying the height of the platform above the ground, a means for adjusting and modifying the inclination of the platform in proclivity/-declivity, and a means for adjusting the inclination of the platform in cubitus/decubitus, characterized essentially in that one of the inclination adjustment means of the platform, either in proclivity/declivity or in cubitus/decubitus, comprises:

(a) a center axis parallel to the plane of the platform, interdependent, that is from the height adjustment means, (b) a first connecting rod extending from one side of the vertical plane including the center axis, hinged by its base to this center axis and by its top to the platform of the bed along a geometric axis parallel to the center axis, (c) a second connecting rod extending from the one side of the vertical plane including the center axis, hinged by its base to the said center axis and the top of which is provided with at least one roller mounted freely rotative on a parallel axis of the center axis. The said roller cooperates in closed circuit with a guide track fixed to the platform, (d) two control devices to adjust and/or modify and maintain the angular position of each rod in relation to the center axis.

According to another feature of the hospital bed or hospital table, the second adjustment means of the inclination of the platform of the bed comprises:

(a) a horizontal shaft supporting the first adjustment means of the inclination. This horizontal shaft is arranged to swivel around its longitudinal axis in two bearings. The bearings are fixed to the height adjustment means, (b) a control device to adjust and/or modify and maintain the angular position of the horizontal shaft around its longitudinal axis.

According to yet another feature, the means for adjusting and maintaining the height of the platform of the bed comprises a horizontal frame. This horizontal frame directly supports one of the two adjustment means of the inclination. The horizontal frame is supported above the base by four connecting rods of equal length. These connecting rods are hinged in pairs substantially by their center and along a common horizontal axis AA'. These four connecting rods are arranged parallel in pairs to form two inclined and intersecting groups. One of the groups is hinged by its lower end to the frame of the base along a parallel axis to the axis AA', and the other one of the groups is hinged by its lower end and again along a parallel axis to the axis AA', to a slider that cooperates in the guiding with two horizontal tracks of the frame of the base. These two groups of connecting rods are hinged, respectively, with their upper ends, again along a parallel axis to the axis AA', to the horizontal frame and to one or several sliders or rollers that cooperate in the sliding or in the rolling with horizontal guiding tracks. The lower slider cooperates with a control device to adjust and/or modify and maintain the position of the slider alongside of the guide tracks.

Owing to these characteristics, the bed is less complex and less costly to manufacture.

Moreover, owing to the use of this type of height adjustment means, the platform of the bed can be lowered to a height of a few centimeters from the ground and can be sufficiently elevated to be put into a vertical position.

These and other objects and advantages of the present invention will become evident from the description which follows. The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 4 is a partial cross-section of the bed illustrating the means to adjust and to maintain the inclination of the platform in proclivity/declivity, FIG. 5 is a top view of the connecting rods of the means to adjust and to maintain the inclination in cubitus/decubitus, FIG. 6 is a partial cross-sectional view along line CC of FIG. 5, FIG. 7 is a partial cross-sectional view along line DD of FIG. 5.

DESCRIPTION OF INVENTION AND PREFERRED EMBODIMENT

Figure 1:
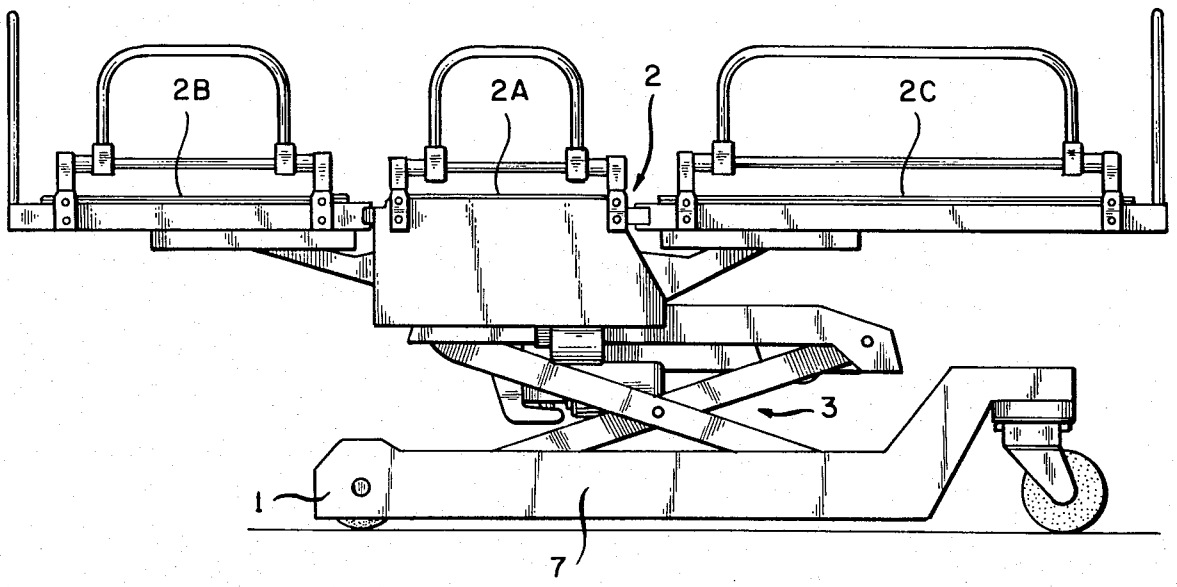
FIG. 1 is a plan view of the bed according to the invention.
Figure 2:
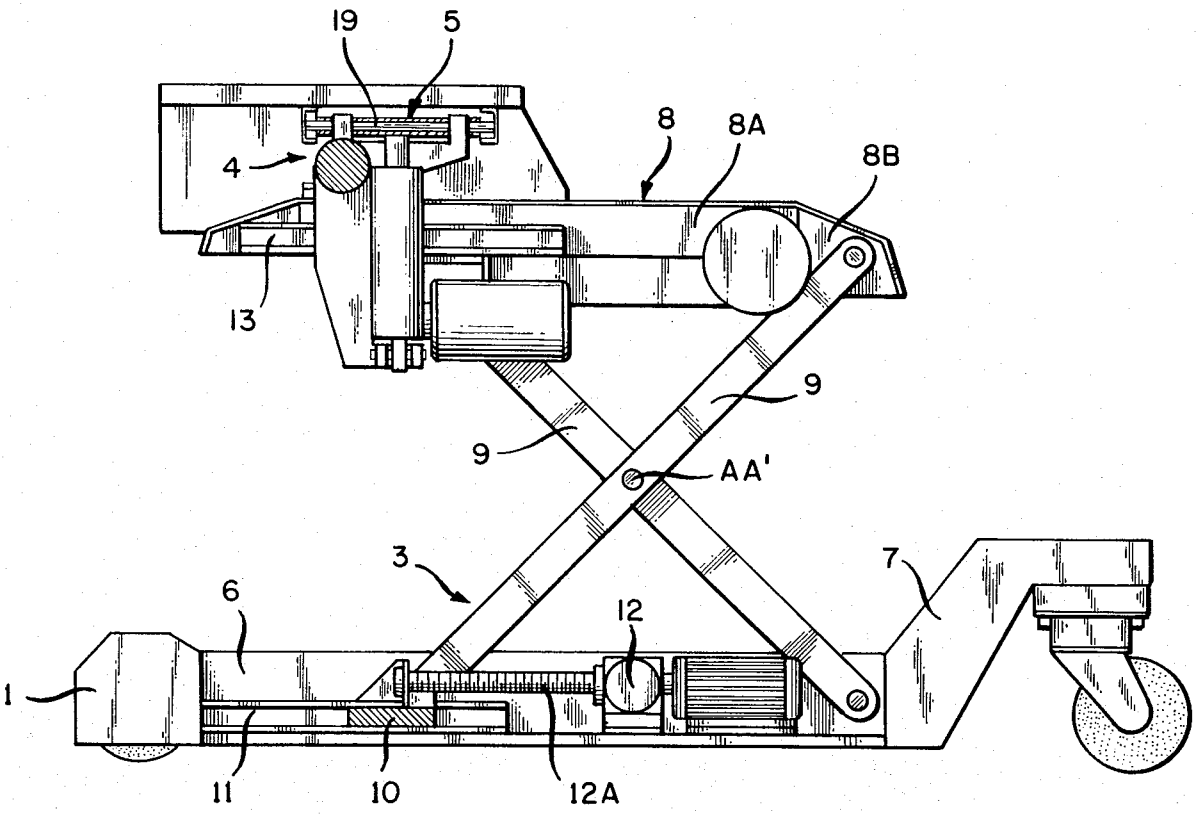
FIG. 2 is a longitudinal cross-section of the bed.
Figure 3:
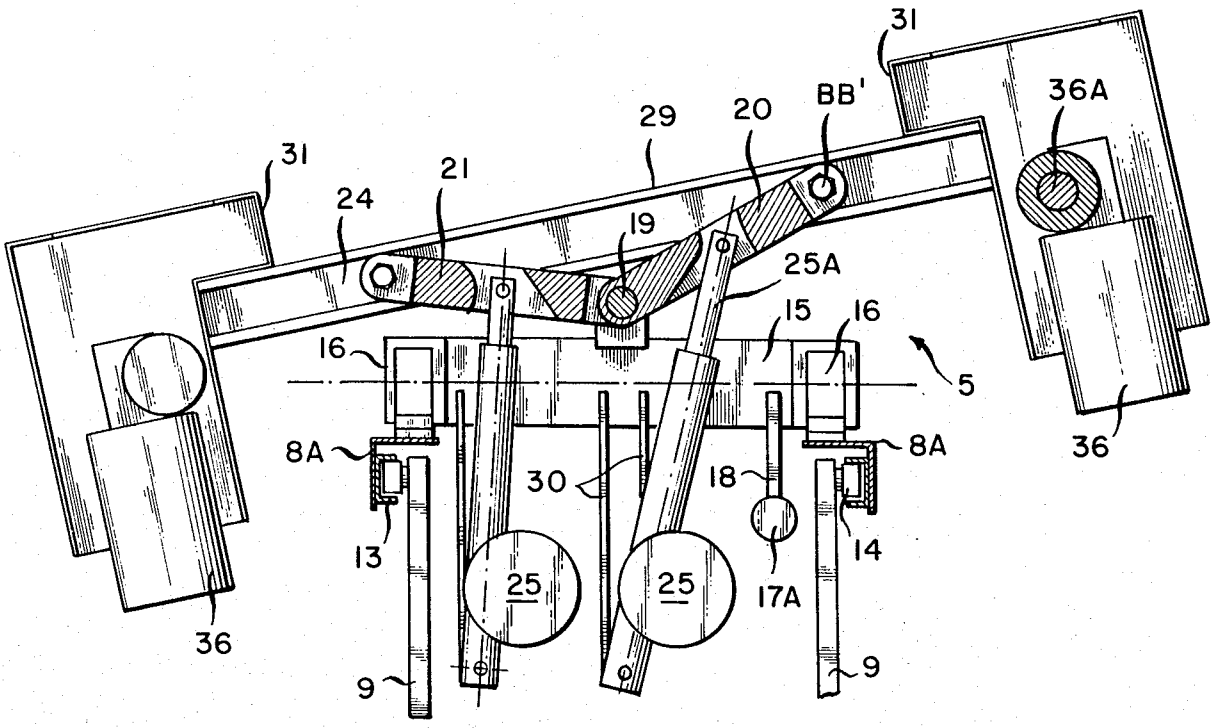
FIG. 3 is a cross-sectional view of the bed illustrating the means to adjust and to maintain the inclination of the platform in cubitus/decubitus.
Figure 8:
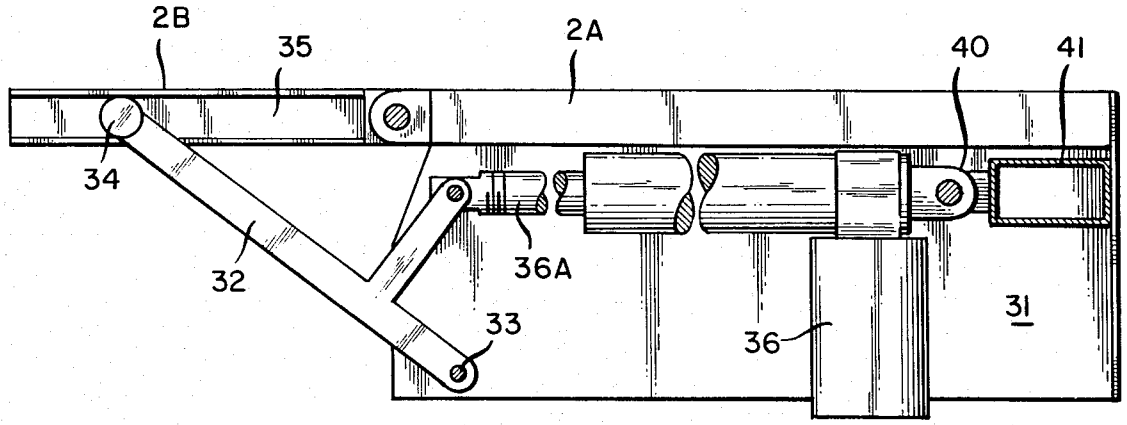
FIG. 8 is a cross-sectional view illustrating the means to adjust and to maintain the inclination of a lateral section by comparison to the center section.

As illustrated, the bed according to the invention comprises a base 1, a platform 2 consisting of several sections 2A, 2B, 2C mounted on a set of means supported by the base. Said set of means comprises a means 3 to adjust and to modify the height of the platform above the ground. The set of means also comprises a means 4 to adjust and modify the inclination of the platform in proclivity/declivity, and a means 5 to adjust and modify the inclination of the platform in cubitus/-decubitus.

The base 1 is made up by a metal frame 6 comprising roller devices on the floor. This metal frame is provided with at least one lateral casing 7. The various devices equipping the bed are disposed in the casing 7. These devices include safety devices, relay devices, control devices, and control devices for the motor device.

The means 3 to adjust the height of the platform above the ground is mounted onto the base of the bed. This adjustment means comprises a frame 8. The frame 8 is made up by assembling of two longitudinal beams 8A with two end crosspieces 8B. On the frame 8 there are mounted the inclination adjustment means. The frame is supported above the base 1 by four connecting rods 9 of equal length, hinged in pairs substantially by their middle and along a common horizontal axis AA'.

These four connecting rods are moreover parallel in pairs to form two inclined and intersecting groups. One of these groups is hinged, along an axis parallel to the axis AA', with its lower end to the beams of the frame of the base. The other one of these groups is hinged, again with the lower end and again along an axis parallel to the axis AA', to a slider 10. The slider 10 cooperates in guiding with two horizontal tracks 11 of the frame of the base.

These horizontal tracks can be made up, for example, by the beams of the frame 8. These guide tracks are made up by a metal section. The right section of the metal section is U-shaped. The guiding rails are disposed in such a way that their sides are horizontal and that the opening of the U, formed by the section of the one guide track, is turned toward the opening of the U formed by the section of the other guide track. The slider extends from one track to the other, penetrates into each of them, and is guided by the sides and the web of each of them.

The upper ends of the two groups of connecting rods are respectively hinged, along an axis parallel to the axis AA', to the horizontal frame 8 and to one or several sliders or rollers 13. The sliders or rollers 13 cooperate in sliding or rolling with the horizontal guide tracks 14 fixed to the said frame 8. The guide tracks of the various sliders extend in a transverse manner relative to the hinge axes.

The height adjustment means of the platform is provided with a control device 12 to adjust and/or to modify and to maintain the position of the slider 10 along the tracks 11.

Preferably, an electric jack of the screw and nut type is provided to serve as the control device 12 to adjust and to maintain the position of the slider 10 shifting along the guide tracks 11. The screw 12A of this jack is kept immobile while rotating and is fixed with its end to the slider. The nut of this jack is fastened while shifting and is connected to an electric motor. The rotation of the nut brings about the displacement of the screw and, consequently, the displacement of the slider 13 along the guide tracks 14 in one direction or in the other direction, depending on the sense of rotation of the nut.

The four connecting rods 9, the lower and upper frame, and the sliders 10 and 13 define a structure of deformable triangles. By deforming the base of these triangles, their height is deformed and, consequently, the height of the upper frame 8 in relation to the floor is modified and thus also the height of the platform 2.

The advantage of such means resides in the fact that they permit to lower the platform 2 down to a small distance off the floor and that they permit to elevate the platform in an adequate manner. The means priorly used did not permit this application.

In its lowered position, the platform of the bed is 54 cm above the floor, whereas in its elevated position, the platform is situated at a distance of 110 cm above the floor.

On the structure of the frame of the height adjustments means, there is mounted one of the two adjustment means of the inclination of the platform of the bed. This adjustment means comprises a horizontal shaft 15. The horizontal shaft 15 supports the other adjustment means of the inclination. The horizontal shaft 15 is arranged to swivel around its longitudinal axis in two bearings 16 fixed to the height adjustment means. Moreover, the adjustment means of the inclination of the platform of the bed comprises a control device 17 to adjust and/or modify and maintain the angular position of the horizontal shaft around its longitudinal axis.

This adjustment means of the inclination is mounted to the upper frame 8. The horizontal shaft 15 extends parallel to the end crosspieces 8B of the frame and the two bearings 16 supporting the horizontal shaft 15 are respectively mounted on one and the other beam 8A.

The control device 17 to adjust and/or modify and maintain the angular position of the horizontal shaft preferably comprises an electric jack of the screw and nut type. This jack is mounted to the upper frame 8 and its screw 17A extends parallel to the beams 8A and is situated closest to the one of the beams. The end of the screw cooperates hingedly with an arm 18 radially fixed to the horizontal shaft 15. This arm extends downwardly. The jack is hingedly fixed to the upper frame 8 by its body. The screw of this jack is immobile while rotating and the nut is immobile while shifting. This nut is in contact with an electric motor. When electric energy is served to the motor, the motor brings about the rotation of the nut in one direction or in the other direction depending on the sense of the polarity. The rotation of the nut results in a shifting of the rod of the jack and this shifting movement results in a swivelling movement of the shaft 15 around its longitudinal axis and, consequently, in an inclination of the platform of the bed.

Preferably, the means described allows to adjust the inclination of the bed in proclivity/declivity, however, it is evident that such a means could be used to adjust the inclination of the platform of the bed in cubitus/-decubitus.

The horizontal shaft 15 of the adjustment means in proclivity/declivity is placed in the immediate vicinity of the front crosspiece 8b in order to be able for the platform of the bed, in its extreme proclivity position, to be placed vertically or along a position close to the vertical.

The adjustment means 5 of the inclination of the bed in cubitus/decubitus, i.e. laterally, be it one side or the other side, is fixedly mounted on the means 4 adjusting the inclination in proclivity/declivity and fixedly accommodates the platform 2 of the bed.

According to a preferred mode of realization, the adjustment means of the inclination of the platform in cubitus/decubitus comprises:

- a central axis 19 parallel to the plane of the platform 2 interdependent of the adjustment means 4 of the inclination in proclivity/declivity,
- a first connecting rod 20 extending from one side of the vertical plane comprising the central axis 19; said connecting rod being hinged by its base to said central axis, and by its top to the platform of the bed along an axis BB′ parallel to the said platform,
- a second connecting rod 21 extending from the other side of the vertical plane comprising the central axis 19 hinged by its base to the said central axis 19 and carrying in its top at least one roller 22; said roller 22 is loosely mounted on an axis 23 parallel to the central axis and cooperates in rolling with a guiding track 24 fixed to the platform 2.

This adjustment means of the inclination of the platform of the bed in cubitus/decubitus comprises moreover two control devices 25, each one of which is connected to a connecting rod. The control devices 25 permit to adjust and/or modify and maintain the angular position of their connecting rods in relation to the central axis 19, i.e. in relation to a point of references associated to this axis.

The platform 2 of the bed is only supported by the two connecting rods 20 and 21. These two connecting rods keep the platform 2 removed from the central axis 19.

Once one of these connecting rods is actuated into swivelling by its modification device of the angular position, the platform is tilted around the top of the other connecting rod. It has to be noted that the swivelling motion of the platform 2 around the top of the second connecting rod 21, which is outfitted with a roller 23, is accompanied by a sliding movement in relation to this latter.

According to a preferred mode of realization, each connecting rod is formed in the shape of a rectangular solid plate. The base of each one of these connecting rods comprises two bearings 26 spaced apart from one another by a relatively large groove or recess 27. The base of the other connecting rod comprises only one single center bearing 28. The width of this central bearing 28 is less than the width of the groove or recess 27 of the base of the first connecting rod. Thus, the two connecting rods can be hinged to the central axis after the manner of a hinge.

According to a preferred mode of realization, the top of each connecting rod cooperates with two parallel crosspieces 29 spaced apart from the framework of the platform of the bed. These crosspieces are made up by two metal sections. The right section of these metal sections has the shape of a U. These crosspieces are mounted in the framework of the platform of the bed in such a way that the openings of the U are turned toward one another. The tops of the connecting rods are mounted between these two crosspieces. The hinge axis of the top of the first connecting rod is fixed to the web of each crosspiece 29. On the other hand, the two rollers of the top of the other connecting rod are respectively guided by the sides of the other crosspiece. These two crosspieces constitute likewise the guide tracks 24.

According to one form of realization, the central axis 19 is fixed radially overhanging the horizontal shaft 15 with the inclination means 4 in proclivity/declivity.

According to a preferred form of realization, the axis 19 is disposed in a perpendicular plane to the shaft 15 and is supported by a support structure 37 fixed overhangingly and radially to the shaft 15. This support structure comprises two projections 38 and 39, each one of which is traversed by a cylindrical opening. The axis 19 is engged and blocked in this cylindrical opening. The first projection 38 is disposed on the shaft 15. The second projection 39 is spaced apart from the first projection and is supported by a wall of the support structure. Each one of these projections is inserted, on the axis 19, between the connecting rods 20 and 21.

Still according to a preferred mode of realization, the devices 25, to adjust and maintain the angular position of the connecting rods, are each made up by an electric jack of the screw and nut type. The screw 25A of each one of these jacks is immobile while rotating. The sliding of the screw is brought about by the rotation of the nut that is connected to an electric motor. This screw, by its end, hingedly cooperates with the corresponding connecting rod.

The adjustment and maintaining devices, connected to each one of these connecting rods, are mounted below these connecting rods and are each hingedly fixed by their bodies to two radial arms 30. These radial arms 30 are fixed to the horizontal shaft of the adjustment means of the inclination in declivity/proclivity. It has to be noted that the devices 25 are disposed between the beams and the crosspieces of the frame of the adjustment means of the inclination of the platform in declivity/provlivity.

The adjustment means of the inclination in cubitus/-decubitus such as described can likewise be used as an adjustment means of the inclination in declivity/proclivity.

As is known, the platform 2 of the bed is made up of several sections, that is to say, a middle section 2A to which are hinged two lateral sections 2B and 2C. The angular position of the two lateral sections 2B and 2C is adjustable in relation to the middle section 2A.

According to a preferred mode of realization, the middle section 2A is directly linked by its framework to the adjustment means of the inclination in cubitus/-decubitus. The framework of this section is made up by the two crosspieces 29 and by two casings 31. These casings are fixed to the ends of these crosspieces in order to form a frame.

Means to adjust and/or modify and maintain the angular positions of the lateral sections in relation to the middle section are disposed in these casings. These means are situated below the upper plane of the middle section. These means are each made up of a lever 32 hinged to an axis 33 interdependent of the casing and comprising an end roller 34 that cooperates while rolling with a rolling track or path 35 of the lateral section. Moreover, this means is equipped with a device 36 to adjust and/or to modify and to maintain the angular position of the lever 32. The adjustment means is made up by an electric jack of the screw and nut type. The body of this jack is fixed by one or several hinges 40 to a crosspiece 41 mounted in the casing 13. The screw 36A of the jack 36 is fixed by a hinge to the lever 32. This fixing point is situated between the hinge axis 33 of the lever and the roller 34.

The bed such as described is equipped with all necessary safety devices, such as end-of-travel transducers that control the interruption of the corresponding movement when they are actuated.

Moreover, this bed, entirely equipped with electric motor devices, has the advantage to lend itself to an automatic control of the various movements (adjustment of the height of the platform and inclinations).

Finally, the bed could be equipped with detection sensors for the detection of the angular position of each connecting rod in relation to the axis 19, of the angular position of the shaft 15 in relation to a reference point allocated to the frame 8, and of the angular position of each lateral section 2B, 2C in relation to the middle section 2A.

It will be understood that each of the elements described above, or two or more together, may also find a useful application in other types of beds or tables differing from the types described above.

While the invention has been illustrated and described as embodied in the context of a hospital bed or a hospital table, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A hospital bed or hospital table comprising a base, a platform consisting of several sections mounted on a set of means supported by the base, which set of means comprises a level means to adjust and modify the height of the platform above the ground, a first angular means to adjust and modify the inclination of the platform in forward and backward direction, and a second angular means to adjust and modify the inclination of the platform in sideways direction, wherein the second angular means of adjustment of the inclination of the platform comprises:

(a) a center axis parallel to the plane of the platform, interdependent with one of the first angular means of adjustment of the inclination and the level means for the adjustment of the height, (b) a first connecting rod extending from one side of a vertical plane, containing the central axis, hinged by its base to this central axis, and by its top to the platform of the bed, along a geometric axis BB' parallel to the central axis, (c) a second connecting rod extending from the other side of the vertical plane, containing the central axis, hinged by its base to said central axis, where the top of said connecting rod is provided with at least one roller mounted freely rotating on an axis parallel to the center axis, with said roller cooperating in closed circuit with a guide track fixed to the platform, (d) and first and second control devices to adjust to modify and to maintain the angular position of each connecting rod in relation to the center axis, i.e. in relation to a reference point allocated to said center axis.

2. The hospital bed according to claim 1 wherein the platform of the bed is supported above the center axis by the two connecting rods.

3. The hospital bed according to claim 1 wherein said center axis is fixedly mounted on the first angular adjustment means of the inclination in forward and backward direction.

4. The hospital bed according to claim 1 wherein the said first angular means comprises:

(a) a horizontal shaft supporting the second angular means and which is mounted by swivelling around its longitudinal axis in two bearings fixed to the level adjustment means, (b) and a third control device to adjust modify and maintain the angular position of the shaft around its longitudinal axis.

5. The hospital bed according to claim 4, wherein the center axis of the first angular means is fixed to a support structure that is fixed to the horizontal shaft of the second angular means in a radial and overhanging manner.

6. The hospital bed or table according to claim 4, wherein said third control device comprises an electric jack of the screw and nut type, with the rod of this jack being fixed by a hinge to an arm radially fixed to the horizontal shaft, the body of this jack being fixed by a hinge to an upper frame that is part of of the means for the adjustment of the height.

7. The hospital bed according to claim 1, wherein said adjustment means of the height of the platform comprises an upper horizontal frame onto which is mounted the two adjustment means of the inclination, in that this upper horizontal frame is formed by assembly of two longitudinal girders and two crossbars and is supported above the base by four connecting rods of equal length, in that these four connecting rods are hinged in pairs substantially by their middle and along a common horizontal axis AA', in that these four connecting rods are parallel in pairs to form two inclined and intersecting groups, in that one of these groups is hinged by its lower end to a frame of the base along an axis parallel to the axis AA', in that the other one of these groups is hinged by its lower end and again along an axis parallel to the axis AA', to a slider that cooperates in guiding with two horizontal tracks of the frame of the base, in that the two groups of connecting rods, by their upper end, are respectively hinged, again along an axis parallel to the axis AA', to the upper horizontal frame and to rollers that cooperate in sliding or rolling in horizontal guide tracks, and in that the lower slider cooperates with a fourth control device to adjust to modify and to maintain its position while shifting along the guide tracks.

8. The hospital bed according to claim 7, comprising a horizontal shaft mounted on the upper horizontal frame of the means to adjust and to modify the height of the platform, wherein the horizontal shaft, parallel to crosspieces of the upper horizontal frame, is disposed in proximity of one of these crosspieces.

9. The hospital bed or hospital table according to claim 8, wherein each of the first and second control devices comprises a screw jack with the rod of each jack being hinged to corresponding connecting rod, the body of each jack being fixed to a hinge having two arms that are radially fixed to the horizontal shaft.

10. The hospital bed according to claim 1, where the platform comprises a middle section to which are hinged two lateral sections, wherein the platform is linked to the second angular means by a framework of a middle section.

11. The hospital bed according to claim 10, wherein the framework of the middle section is made up by two crosspieces and by two casings linked to the crosspieces in such a way so as to form a frame, and in that the crosspieces cooperate in hinging with the first connecting rod and in sliding with the rollers of the second connecting rod of the second angular means for the adjustment of the inclination in sideways direction.

12. The hospital bed according to claim 1, where each of the connecting rods is made up of a solid wall plate of substantially rectangular shape.

* * * * *